US005671644A

United States Patent [19]

Anderson

[11] Patent Number: 5,671,644

[45] Date of Patent: Sep. 30, 1997

[54] OPEN-ENDED RATCHETING WRENCH

[75] Inventor: James R. Anderson, Menominee, Mich.

[73] Assignee: Evergreen Tool Co., Inc., Menominee, Mich.

[21] Appl. No.: 439,815

[22] Filed: May 11, 1995

[51] Int. Cl.[6] ..... B25B 13/02

[52] U.S. Cl. ..... 81/119; 81/186

[58] Field of Search ..... 81/119, 186

[56] References Cited

U.S. PATENT DOCUMENTS

| | | | |
|---|---|---|---|
| 3,875,828 | 4/1975 | Evans | 81/119 |
| 3,931,749 | 1/1976 | Evans | 81/119 |

FOREIGN PATENT DOCUMENTS

| | | | |
|---|---|---|---|
| 770360 | 6/1934 | France | 81/119 |
| 217710 | 6/1924 | United Kingdom | 81/119 |

*Primary Examiner*—James G. Smith

*Attorney, Agent, or Firm*—Michael, Best & Friedrich

[57] ABSTRACT

The invention provides an open-ended ratcheting wrench for a hex head fastener. The wrench includes a jaw having an inner surface defining an opening for receiving the fastener. The inner surface includes arcuate heel and nose surfaces that are configured to cause the jaw to ratchet when it is rotated in one direction and that drive the fastener when the jaw is rotated in the opposite direction. The inner surface also includes tapered surfaces that provide undercut areas to protect the corners on the fastener when torque is applied to the fastener. This reduces wear at the corners. The wrench also includes a manually operable handle for rotating the jaw.

12 Claims, 2 Drawing Sheets

OPEN-ENDED RATCHETING WRENCH

BACKGROUND OF THE INVENTION

1. Field of the Invention

The invention relates generally to wrenches, and more particularly to open-ended ratcheting wrenches.

2. Reference to Prior Art

Open-ended wrenches, such as crescent wrenches for example, that must be rotated in an arc to tighten and loosen fasteners and that must be removed from the fastener after each working stroke and repositioned on the nut for the next stroke are well known. Examples of other such wrenches are illustrated in French Patent Nos. 1,022,607 and 1,236,324.

It is also known to provide for ratcheting action in the handle of a wrench. For example, U.S. Pat. No. 4,74,862 illustrates an open-ended wrench known as a crowfoot-type wrench. That wrench is semi-annular and has an inner surface for engaging a hexagonal nut. That wrench is also provided with a rectangular socket adapted to receive a complementary protrusion on the end of a click- or ratcheting-type torque handle. Moving parts within the handle, and not the wrench itself, provide the ratcheting action. Crowfoot-type wrenches, however, suffer from some disadvantages. For example, like socket wrenches, crowfoot wrenches are positioned on fasteners from above, i.e., in the direction of the fastener axis, and not from the side like a crescent wrench. For that reason crowfoot-type wrenches are often not suitable for closely confined areas. Crowfoot-type wrenches are also susceptible to slipping relative to a fastener.

Wrenches that are intended to ratchet (i.e., the wrench can be repositioned on a fastener for another stroke without having to remove the wrench from the fastener) without the aid of a ratcheting-type handle are also known. Those designs also suffer from certain disadvantages. For example, some ratcheting wrenches drive one or more of the corners or points of a fastener and when over-torqued can result in corner roundoff or stripping. Others are not positionable around a fastener from a direction transverse to the axis of the fastener. Still others are prone to slip relative to the fastener, especially if the drive surfaces on the wrench do not snugly fit the fastener. Examples of ratcheting wrenches are provided in U.S. Pat. Nos. 3,785,226, 3,868,873, 3,875,828, 3,931,749 and 3,905,255.

SUMMARY OF THE INVENTION

The invention provides an improved open-ended ratcheting wrench. The wrench is positionable around a fastener from a direction transverse to the axis of the fastener and is useable in confined areas where access to the fastener and stroke length of a handle used to rotate the wrench are limited. The wrench is also configured to achieve a ratcheting action without relatively movable parts or excessive operator applied torques. Additionally, the operating surfaces of the wrench are arranged so that when the wrench is being rotated to tighten or loosen a fastener those surfaces engage the flat areas of the fastener and avoid contact with the corners of the fastener to prevent those corners from being worn or rounded off. To decrease the possibility that the wrench will slip off the fastener, the operating surfaces of the wrench are also arranged to bias the wrench snugly onto the fastener as increasing torque is applied by an operator.

More particularly, the invention provides an open-ended ratchsting wrench including a jaw having an inner surface adapted to engage a fastener. The inner surface defines an opening in the jaw for receiving the fastener, and the inner surface includes an arcuate heel surface and an arcuate nose surface opposing the arcuate heel surface. The arcuate nose and heel surfaces define therebetween a mouth for the opening. The inner surface also includes a lower relief face extending from the arcuate heel surface, a lower back face extending transversely from the lower relief face, an upper back face extending transversely from the lower back face, and an upper drive face extending transversely from the upper back face to the arcuate nose surface. The wrench also includes a handle extending from the jaw. The handle is operable to rotate the jaw in a first direction wherein the arcuate nose surface leads and the jaw is adapted to ratchet over a fastener, and in a second direction wherein the arcuate heel surface leads and the upper drive face is adapted to grip a fastener so that the fastener and the jaw rotate in unison.

The invention also provides a ratcheting wrench for use with a hex head fastener. The wrench includes a jaw having a lower jaw section with a heel portion, an upper jaw section with a nose portion, and an inner surface. The inner surface defines an opening in the jaw for receiving a hex head fastener, and the heel and nose portions define a mouth for the opening. The inner surface includes an arcuate surface on the heel portion and at the mouth of the opening. A first planar surface on the lower jaw section and extends from the arcuate surface on the nose portion away from the mouth of the opening. A second planar surface on the lower jaw section extends transversely from the first planar surface away from the mouth of the opening, and the first and second planar surfaces form a first undercut angle. A third planar surface on the upper jaw section extends transversely from the second planar surface toward the mouth of the opening, and the second and third planar surfaces are oriented in complementary relation to a pair of adjacent side surfaces on the fastener. The second and third planar surfaces also form an angle greater than the first undercut angle so that when adjacent side surfaces of the fastener are seated in complementary relation against the second and third planar surfaces the first planar surface and the fastener define therebetween a lower jaw clearance space. A fourth planar surface on the upper jaw section extends transversely from the third planar surface toward the mouth of the opening, and the third and fourth planar surfaces form a second undercut angle. The angle formed by the second and third planar surfaces is greater than the second undercut angle so that when a pair of adjacent side surfaces of the fastener are seated in complementary relation against the second and third planar surfaces the fourth planar surface and the fastener define therebetween an upper jaw clearance space. An arcuate surface on the nose portion extends from the fourth planar surface. The wrench also includes means for rotating the jaw alternatively in a first direction, and a second direction opposite the first direction.

The invention also provides a method for ratcheting the jaw of a wrench relative to a fastener. The method includes the first step of providing an open-ended jaw in accordance with the foregoing. A pair of side surfaces of the fastener are then positioned in complementary relation on the second and third planar surfaces so that the first planar surface and the fastener define therebetween a lower clearance space and so that the fourth planar surface and the fastener define therebetween an upper clearance space. The jaw is the rotated to narrow the lower clearance space, expand the upper clearance space, and unseat the fastener from its seated position against the second and third planar surfaces. The jaw is then further rotated to bring the nose surface into contact with an opposing side surface on the fastener and the nose surface is advanced along that opposing side surface on the fastener while the fastener slides along the first planar surface toward the mouth of the opening and then along the heel surface until the nose surface clears the opposing side surface of the fastener. The jaw is then urged toward the fastener so that a pair of adjacent side surfaces on the fastener again seat against the second and third planar surfaces.

Other features and advantages of the invention will become apparent to those skilled in the art upon review of the following detailed description, claims and drawings.

Figure 1:
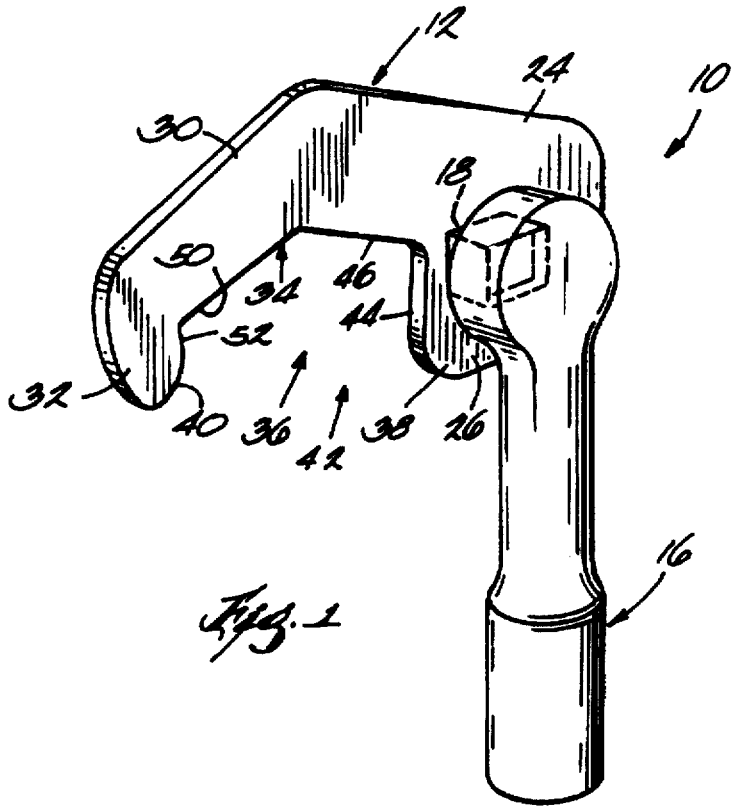
FIG. 1 a perspective view of a wrench embodying the invention. /

Before an embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF A PREFERRED EMBODIMENT

Illustrated in FIG. 1 is a wrench 10 embodying features of the invention. While the wrench 10 can be of single- or multiple-piece construction, in the embodiment illustrated in the drawings the wrench 10 is a two-piece unit and includes a jaw 12 for engaging a fastener 14 and a handle 16 for rotating the jaw 12 to turn the fastener 14. The handle 16 is provided with a rectangular protrusion 18 (shown schematically) for engaging the jaw 12, as is further explained below.

In the particular arrangement illustrated in the drawings the jaw 12 is open-ended and is designed to be used with hex head fasteners. Thus, the fastener 14 is hexagonal and includes (FIGS. 3 and 8) six planar side surfaces 20*a–f* which each intersect an adjacent side surface at a 120 degree angle to form corners or points 22*a–f*.

Figure 2:
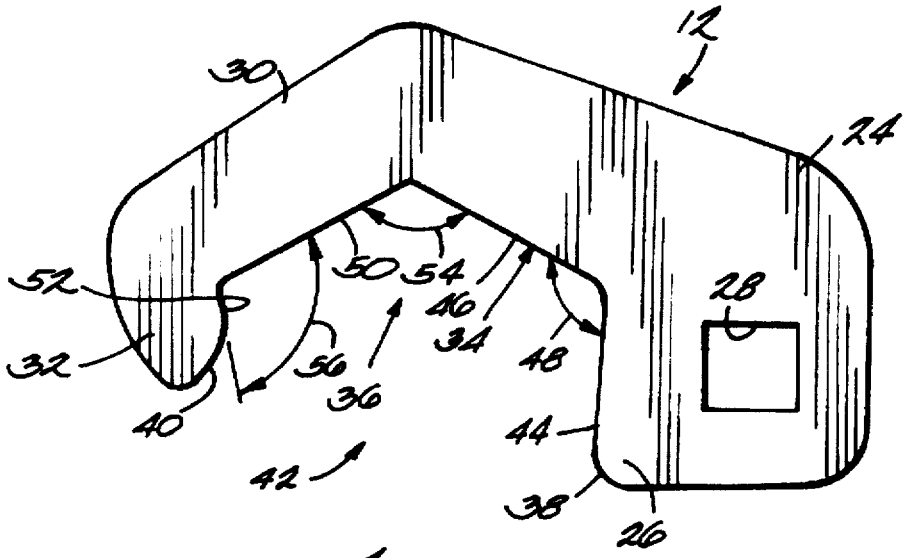
FIG. 2 is an enlarged side elevational view of the jaw used in the wrench of FIG. 1.

As shown in FIGS. 1 and 2, the jaw 12 is a generally flat body and includes a lower jaw section 24 having a heel portion 26 and a rectangular hole 28 for receiving the protrusion 18 on the handle 16. The jaw 12 also includes an upper jaw section 30 having a nose portion 32. The lower and upper jaw sections 24 and 30 form an inner surface 34 that defines an opening 36 sized to receive the fastener 14. As is further explained below, the inner surface 34 is configured to exert torque on the fastener 14 when the jaw 12 is rotated in one direction and to slip relative to the fastener 14 in a ratcheting action when the jaw 12 is rotated in the opposite direction.

The inner surface 34 includes an arcuate heel surface 38 on the heel portion 26 and an opposing arcuate nose surface 40 on the nose portion 32. The heel surface 38 and the nose surface 40 define therebetween an entry space or mouth 42 for the opening 36. The inner surface 34 also includes planar first and second surfaces on the lower jaw section 24. Those surfaces include a lower relief face 44 extending tangentially from the heel surface 38 and generally away from the mouth 42 and a lower back face 46 that extends generally away from the mouth 42 from the termination of the lower relief face 44. The lower relief face 44 and the lower back face 46 are transversely oriented and form an undercut lower relief angle indicated by reference numeral 48 (FIG. 2).

Figure 8:
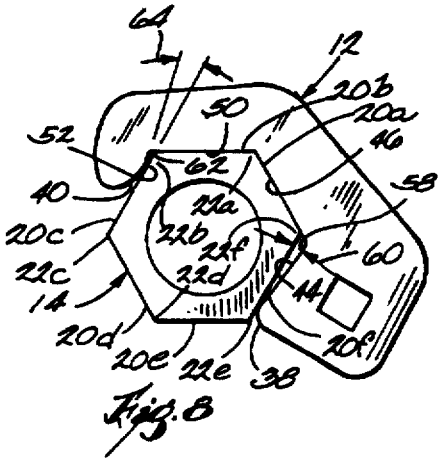

The inner surface 34 also includes planar third and fourth surfaces on the upper jaw section 30. Those surfaces include an upper back face 50 extending generally toward the mouth 42 from the termination of the lower back face 46 and an upper drive face 52 extending from the termination of the upper back face 46 generally toward the mouth 42 to the nose surface 40. The lower and upper back faces 46 and 50 are oriented relative to one another at an angle 54 (FIG. 2) so as to be complementary to pairs of adjacent side surfaces 20*a–f* on the fastener 14. This permits a pair of the side surfaces 20*a–f* to seat (as shown in FIG. 8) in flush, linear contact with those faces. In the illustrated embodiment, angle 54 is 120 degrees and the lower and upper back faces 46 and 50 are each slightly longer (see FIGS. 3 and 8) than the side surfaces 20*a–f* of the fastener 14. The upper drive face 52 is also oriented transversely to the upper back face 50 and forms an undercut upper relief angle 56 (FIG. 2) therewith. Relief angles 48 and 56 are both less than angle 54 for reasons more fully explained below.

Figure 3:
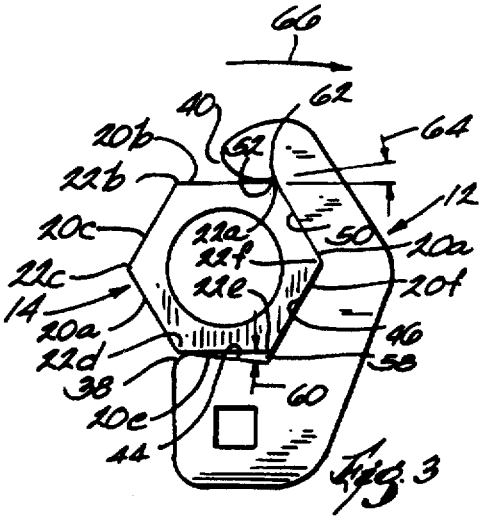
FIG. 3 is a side elevation view of the jaw used in the wrench of FIG. 1 and shows the jaw positioned around a fastener and at the end of a work strok.

When the jaw 12 and the fastener 14 are positioned as shown in FIGS. 3 and 8, relief or clearance spaces are formed between the inner surface 34 and the fastener 14. In particular the lower relief face 44 and the opposing fastener side surface (20*f* in FIG. 8 and 20*e* in FIG. 30) define a lower jaw clearance space 58. An angle 60 formed by the lower relief face 44 and the opposing fastener side surface and representing the taper of the lower relief surface is about 3–4 degrees and preferably about 3.5 degrees. Additionally, the upper drive face 52 and the opposing fastener side surface (20*c* in FIG. 8 and 20*b* in FIG. 3) define an upper jaw clearance space 62, and an angle 64 formed between those surfaces represents the taper of the upper drive face 52 and is preferably about 10–12 degrees.

Operation of the jaw 12 is explained with reference to FIGS. 3–8. In particular, the jaw 12 is first placed around the fastener 14 by advancing the jaw 12 sideways toward the fastener 14 until the fastener 14 is received in the opening 36. To tighten the fastener 14, which in the illustrated arrangement is a righthand fastener, the jaw 12 is rotated in a clockwise direction (FIG. 3) indicated by arrow 66. As this occurs, the upper drive face 52 bears against the opposing fastener side surface 20*b*. This in turn urges fastener side surface 20*a* into firm engagement with the upper back face 50 to help maintain firm engagement between the jaw 12 and the fastener 14 and to thereby reduce slipping therebetween. This is especially advantageous when the points 22*a–f* are somewhat worn or the fastener 14 is slightly undersized. As the upper drive face 52 is brought to bear against opposing fastener side surface 20*b* the heel surface 38 is also brought to bear against opposing fastener side surface 20*e* to create a moment on the fastener 14. Under the foregoing conditions the jaw 12 and the fastener 14 rotate in unison. To loosen the fastener 14 the jaw 12 is flipped over and the process repeated.

It is noted that in the driving stroke of the jaw 12 the fastener 14 is not driven primarily through the fastener points 22*a–f* as in some prior art wrenches. Instead, the fastener 14 is driven primarily through the side surfaces 20*a–f*. For example, as shown in FIG. 3 the lower and upper clearance spaces 58 and 62 provide relief areas for fastener points 22*a* and 22*e*, and the upper drive face 52 and the heel surface 38 engage the fastener 14 at locations spaced from the fastener points 22*a–f*. This helps avoid wearing the points 22*a–f* off the fastener 14. Thus, the tapered lower relief face 44 and the upper drive face 52 function as part of a means for providing relief at the fastener points 22*a–f*.

Figure 4:
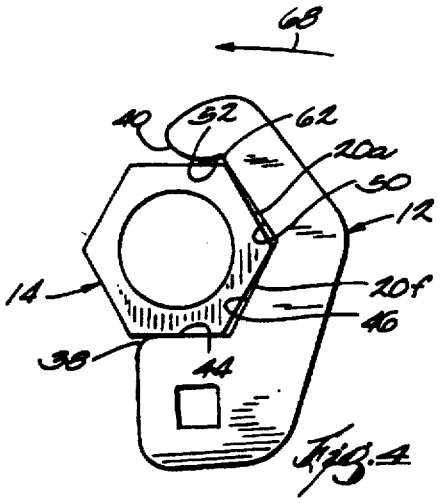
FIGS. 4–8 are views similar to FIG. 3 and show the jaw in a series of positions to illustrate the ratcheting action of the jaw.
Figure 5:
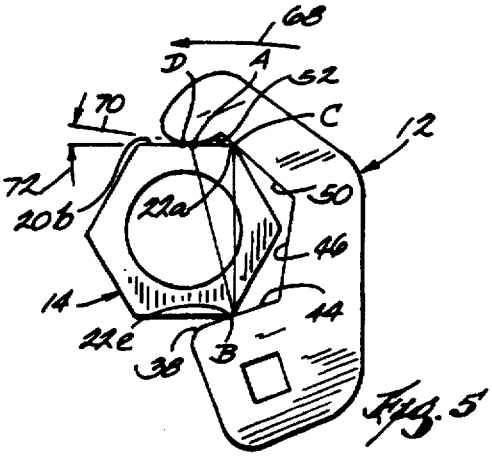
Figure 6:
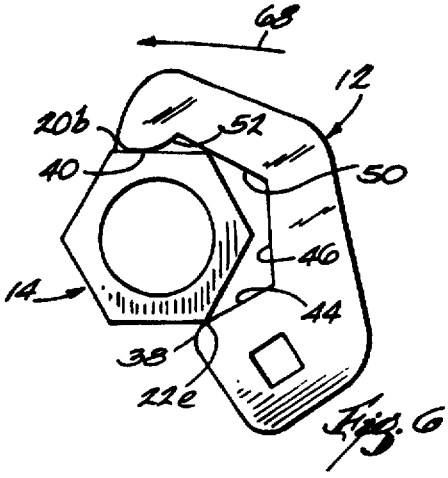

To reposition the jaw 12 for a new stroke (the jaw 12 is illustrated at the end of a stroke in FIG. 3), the jaw 12 is rotated via the handle 16 in a counterclockwise direction indicated by arrow 68. As shown in FIG. 4, initial counterclockwise rotation of the jaw 12 from its position shown in FIG. 3 closes lower clearance space 58 which in turn slightly unseats the fastener side surfaces 20*a* and 20*f* from the lower and upper back faces 46 and 50 and slightly enlarges upper clearance space 62. Continued counterclockwise rotation of the jaw 12 then brings (see FIG. 5) the nose surface 40 into contact with the opposing fastener side surface 20*b* as fastener point 22*a* slides down the upper back face 50 and fastener point 22*e* slides up the lower relief face 44 toward the heel surface 38. As shown in FIG. 5, the nose surface 40 engages the fastener 14 at a point of contact A, and the fastener 14 is also engaged at contact points B and C. It is believed that to insure pivoting, a tangent 70 which is drawn through the next successive point of contact on the nose surface 40, which is indicated for illustrative purposes by D, must form a positive angle 72 with the opposing fastener side surface 20*b*.

Figure 7:
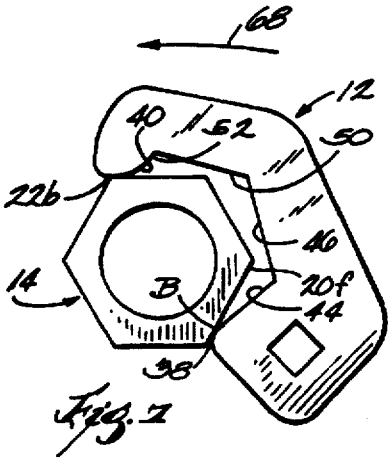

Following contact of the nose surface 40 with opposing fastener side surface 20*b*, the nose surface 40 is advanced (FIG. 6) along the opposing fastener side surface 20*b* while the fastener point 22*e* slides along the lower relief face 44 toward the mouth 42 of the opening 36. As the fastener point 22*e* slides over the heel surface 38 the point of contact B between the heel surface 38 and the fastener 14 shifts to the fastener side surface 20*f* (FIG. 7). Thereafter, the nose surface 40 is free to slide up the remainder of the fastener side surface 20*b* to clear the fastener point 22*b* so that the fastener 14 can reseat against the lower and upper back faces 46 and 50 (FIG. 8). The jaw 12 is now ready for the next work stroke.

While in the illustrated arrangement the jaw 12 is configured for use with a hexagonal fastener 14, it will be understood by those skilled in the art that the inner surface 34 of the jaw 12 could be reconfigured for use with other fasteners.

Advantageously, the wrench 10 is designed to combine a number of desirable features in a single piece open-ended jaw 12 that is useable in confined areas where fastener access and handle stroke length may be limited. The jaw 12 provides a ratcheting capability, and the jaw 12 is designed to firmly grip a fastener during a working stroke, even if the fastener is somewhat undersized, to prevent the jaw 12 from slipping off the fastener. Additionally, the jaw 12 is designed to drive flat areas of the fastener and to avoid direct contact with the fastener points to prevent wear.

Various features of the invention are set forth in the following claims.

I claim:

1. An open-ended ratcheting wrench for a fastener having a plurality of flat side surfaces, the open-ended ratcheting wrench comprising:

a jaw including an inner surface adapted to engage a fastener having a plurality of flat side surfaces, the inner surface defining an opening in the jaw for receiving the fastener, and the inner surface including an arcuate heel surface, an arcuate nose surface opposing the arcuate heel surface, the arcuate nose and heel surfaces defining therebetween a mouth for the opening, a lower relief face extending from the arcuate heel surface and away from the mouth of the opening, a lower back face extending transversely from the lower relief face and away from the mouth of the opening, an upper back face extending transversely from the lower back face toward the mouth of the opening, and an upper drive face extending transversely from the upper back face to the arcuate nose surface, wherein the lower and upper back faces are oriented in complementary relation to a pair of adjacent side surfaces on the fastener so that the adjacent side surfaces are seatable in linear contact with the lower and upper back faces, the lower and upper back faces forming an angle, wherein the lower relief face and the lower back face form a lower relief angle that is less than the angle formed between the lower and upper back faces so that when adjacent side surfaces of the fastener are seated in complementary relation against the upper and lower back faces the lower relief surface and an opposing side surface of the fastener define therebetween a lower clearance space; and a handle extending from the jaw, the handle being operable to rotate the jaw in a first direction wherein the arcuate nose surface leads and the jaw is adapted to ratchet over a fastener, and in a second direction opposite the first direction wherein the arcuate heel surface leads and the upper drive face is adapted to grip a fastener so that the fastener and the jaw rotate in unison.

2. An open-ended ratcheting wrench as set forth in claim 1 wherein each of the lower relief face, the lower back face, the upper back face, and the upper drive face is a planar surface.

3. An open-ended ratcheting wrench as set forth in claim 2 wherein the lower relief face extends tangentially from the arcuate heel surface.

4. An open-ended ratcheting wrench as set forth in claim 2 wherein the lower and upper back faces are oriented in complementary relation to a pair of adjacent side surfaces on the fastener so that said adjacent side surfaces are seatable in linear contact with the lower and upper back faces, and the lower and upper back faces forming an angle, wherein the upper back face and the upper drive face form an undercut angle, the angle formed by the lower and upper back faces being greater than the undercut angle so that when a pair of adjacent side surfaces of the fastener are seated in complementary relation against the lower and upper back faces the upper drive surface and an opposing side surface of the fastener define therebetween an upper clearance space.

5. An open-ended ratcheting wrench as set forth in claim 1 wherein contact between the arcuate nose surface and an opposing side surface on the fastener is made at a contact point on the arcuate nose surface, and wherein the arcuate nose surface is curved so that a tangent through the next successive contact point on the arcuate nose surface forms a positive angle with said opposing side surface on the fastener.

6. An open-ended ratcheting wrench for a fastener having a plurality of flat side surfaces, the open-ended ratcheting wrench comprising:

a jaw including an inner surface adapted to engage a fastener having a plurality of flat side surfaces, the inner surface defining an opening in the jaw for receiving the fastener, and the inner surface including an arcuate heel surface, an arcuate nose surface opposing the arcuate heel surface, the arcuate nose and heel surfaces defining therebetween a mouth for the opening, a lower relief face extending from the arcuate heel surface and away from the mouth of the opening, a lower back face extending transversely from the lower relief face and away from the mouth of the opening, an upper back face extending transversely from the lower back face toward the mouth of the opening, and an upper drive face extending transversely from the upper back face to the arcuate nose surface, wherein the upper back face and the upper drive face form an upper relief angle, wherein the lower back face and the upper back face form an angle, wherein the angle formed by the lower and upper back faces is greater than the upper relief angle so that when a pair of adjacent side surfaces of the fastener are seated in complementary relation against the lower and upper back faces the upper drive surface and an opposing face of the fastener define therebetween an upper clearance space; and a handle extending from the jaw, the handle being operable to rotate the jaw in a first direction wherein the arcuate nose surface leads and the jaw is adapted to ratchet over a fastener, and in a second direction opposite the first direction wherein the arcuate heel surface leads and the upper drive face is adapted to grip a fastener so that the fastener and the jaw rotate in unison.

7. An open-ended ratcheting wrench as set forth in claim 6 wherein rotation of the jaw in the first direction after a pair of adjacent side surfaces of the fastener are first seated in complementary relation against the lower and upper back faces narrows the lower clearance space which in turn expands the upper clearance space and withdraws said adjacent side surfaces of the fastener from their seated positions against the lower and upper back faces, and continued rotation of the jaw in the first direction first brings the arcuate nose surface into contact with an opposing side surface on the fastener and then advances the arcuate nose surface along said opposing side surface on the fastener while the fastener slides along the lower relief face toward the mouth of the opening and then along the arcuate heel surface until the arcuate nose surface clears said opposing side surface of the fastener so that a pair of adjacent side surfaces on the fastener can again seat in complementary relation against the upper and lower back faces.

8. A ratcheting wrench for use with a hex head fastener, the ratcheting wrench comprising:

a jaw including a lower jaw section, the lower jaw section including a heel portion, an upper jaw section, the upper jaw section including a nose portion, an inner surface defining an opening in the jaw for receiving a hex head fastener, the heel portion and the nose portion defining therebetween a mouth for the opening, the inner surface, proceeding serially from the heel portion to the nose portion, including an arcuate surface on the heel portion and at the mouth of the opening, a first planar surface on the lower jaw section and extending from the arcuate surface on the nose portion away from the mouth of the opening, a second planar surface on the lower jaw section, the second planar surface extending transversely from the first planar surface away from the mouth of the opening, the first and second planar surfaces forming a first undercut angle, a third planar surface on the upper jaw section, the third planar surface extending transversely from the second planar surface toward the mouth of the opening, the second and third planar surfaces being oriented in complementary relation to a pair of adjacent side surfaces on the fastener, and the second and third planar surfaces forming an angle greater than the first undercut angle so that when adjacent side surfaces of the fastener are seated in complementary relation against the second and third planar surfaces the first planar surface and the fastener define therebetween a lower jaw clearance space, a fourth planar surface on the upper jaw section, the fourth planar surface extending transversely from the third planar surface toward the mouth of the opening, the third and fourth planar surfaces forming a second undercut angle, the angle formed by the second and third planar surfaces being greater than the second undercut angle so that when a pair of adjacent side surfaces of the fastener are seated in complementary relation against the second and third planar surfaces the fourth planar surface and the fastener define therebetween an upper jaw clearance space, and an arcuate surface on the nose portion and at the mouth of the opening, the arcuate surface on the nose portion extending from the fourth planar surface, and means for rotating the jaw alternatively in a first direction, and a second direction opposite the first direction, whereby rotation of the jaw in the first direction after a pair of adjacent side surfaces of the fastener are first seated in complementary relation against the second and third planar surfaces is absorbed initially by narrowing the lower jaw clearance space which in turn expands the upper jaw clearance space and withdraws said adjacent side surfaces of the fastener from their seated positions against the second and third planar surfaces, and continued rotation of the wrench in the first direction first brings the arcuate surface on the nose portion into contact with an opposing side surface on the fastener and then advances the nose portion along said opposing side surface on the fastener while the fastener slides along the first planar surface toward the mouth of the opening and then along the arcuate surface on the heel portion until the nose portion clears said opposing side surface on the fastener so that a pair of adjacent side surfaces on the fastener can again seat in complementary relation against the second and third planar surfaces, and whereby rotation of the jaw in the second direction urges the fastener into engagement with the upper and lower jaw sections so that the fastener and the jaw rotate in unison.

9. A ratcheting wrench as set forth in claim 8 wherein the contact between the arcuate surface on the nose portion and an opposing side surface on the fastener is made at a contact point, and wherein a tangent through the next successive contact point on the arcuate surface of the nose portion forms a positive angle with the opposing side surface on the fastener.

10. A ratcheting wrench as set forth in claim 8 wherein each of the first and fourth planar surfaces is oriented so that it always extends transversely with respect to an opposing one of the side surfaces of the fastener.

11. A ratcheting wrench as set forth in claim 8 wherein the first and fourth planar surfaces are transversely oriented and form an acute angle when extended beyond the mouth of the opening.

12. A ratcheting wrench as set forth in claim 8 wherein the fastener includes points, and the jaw includes means for providing relief at the points when the jaw is rotated in the second direction, the means for providing relief including the first and fourth planar surfaces.

* * * * *